US007797963B2

(12) United States Patent
Barone et al.

(10) Patent No.: US 7,797,963 B2
(45) Date of Patent: Sep. 21, 2010

(54) REFRIGERATOR WITH MOISTURE ADSORBING DEVICE

(75) Inventors: Diego Barone, Bergamo (IT); Enrica Monticelli, Varese (IT); Lorenzo Bianchi, Varese (IT); Giuliano Rosi, Siena (IT); Luca Nardi, Siena (IT)

(73) Assignee: Whirlpool Corporation, Benton Harbor, MI (US)

( * ) Notice: Subject to any disclaimer, the term of this patent is extended or adjusted under 35 U.S.C. 154(b) by 236 days.

(21) Appl. No.: 11/668,506

(22) Filed: Jan. 30, 2007

(65) Prior Publication Data

US 2007/0175330 A1 Aug. 2, 2007

(30) Foreign Application Priority Data

Jan. 30, 2006 (EP) ..... 06101048

(51) Int. Cl.
*F24F 3/16* (2006.01)

(52) U.S. Cl. ..... 62/440; 62/78; 96/147; 422/122

(58) Field of Classification Search ..... 62/440–441, 62/474, 78, 409–410; 96/147; 422/122
See application file for complete search history.

(56) References Cited

U.S. PATENT DOCUMENTS 1,619,066 A * 3/1927 Fotch ..... 454/183
2,217,204 A 10/1940 Jalma
2,317,816 A * 4/1943 Scott ..... 62/159
2,604,760 A 7/1952 Southern
2,775,873 A * 1/1957 Jones ..... 62/281
3,065,595 A 11/1962 Gary
3,712,029 A 1/1973 Charlton
3,945,217 A 3/1976 Bashark
4,660,385 A 4/1987 Macriss et al.
5,062,272 A * 11/1991 Burns ..... 62/78
5,427,609 A 6/1995 Zoglman et al.
5,468,447 A 11/1995 Bermas
5,501,084 A * 3/1996 Chang et al. ..... 62/264
5,568,730 A * 10/1996 Kim et al. ..... 62/78
5,772,959 A * 6/1998 Bermas ..... 422/5
6,286,330 B1 * 9/2001 Kopf ..... 62/314
6,990,819 B2 1/2006 Darling

FOREIGN PATENT DOCUMENTS

EP 0031311 A2 7/1981
EP 0805321 A1 11/1997
EP 1839728 A1 10/2007
WO 83/01293 A1 4/1983

* cited by examiner

*Primary Examiner*—William E Tapolcai

(57) ABSTRACT

The present invention relates to a refrigerator having a cabinet forming a fresh food storage compartment and a freezer compartment, at least one door for opening and closing the cabinet, and an adsorbing device containing a desiccant material for collecting moisture from air inside the cabinet, wherein the adsorbing device is mounted inside the cabinet.

10 Claims, 3 Drawing Sheets

| DATE | DAY | SEPARATOR | | SEPARATOR & PAN | | DOOR | |
|---|---|---|---|---|---|---|---|
| | | 3 | 4 | 5 | 6 | 7 | 8 |
| 17/11/2005 | 0 | 1838,7 | 1834,8 | 1835,3 | 1837,8 | 2342,5 | 2326,9 |
| 24/11/2005 | 7 | 1860,5 | 1855,3 | 1917,6 | 1861,2 | 2365,1 | 2348,8 |
| 01/12/2005 | 14 | 1882,4 | 1874,0 | 1975,8 | 1884,3 | 2382,6 | 2358,3 |
| 09/12/2005 | 22 | 1907,5 | 1894,4 | 2018,3 | 1912,8 | 2401,2 | 2372,9 |
| 15/12/2005 | 28 | 1922,2 | 1906,5 | 2057,2 | 1932,2 | 2409,6 | 2384,8 |
| 23/12/2005 | 36 | 1938,2 | 1922,1 | 2106,7 | 1953,0 | 2422,1 | 2392,8 |
| 04/01/2006 | 48 | 1968,6 | 1946,6 | 2172,6 | 1983,3 | 2412,3 | 2437,4 |
| 12/01/2006 | 56 | 1984,0 | 1961,5 | 2217,0 | 2002,0 | 2421,6 | 2448,0 |

REFRIGERATOR WITH MOISTURE ADSORBING DEVICE

BACKGROUND OF THE INVENTION

1. Field of the Invention

The present invention relates to a refrigerator comprising a cabinet forming a food storage space and a door for opening and closing the space.

2. Description of the Related Art

It is well known that direct cooled freezers present the problem of manual defrosting of evaporators, due to the frost build-up during normal operation of the direct cooled freezer.

Manual defrosting of direct cooled freezers can be very time consuming for users. A user must remove all of the frozen goods from the freezer and manually initiate the defrosting routines. This causes the user to schedule this activity carefully in advance, to avoid spoiling the frozen goods during the defrost operation.

The most prevalent alternative technique to manually defrost is related to hot gas defrosting of a freezer evaporator, which allows quick defrosting by hot gas circulation which melts the frost layer. However, this is not an easy operation since the user still must remove all of the frozen goods from the freezer, then make the frost layer melt by the hot gas defrosting, and finally put the goods back in the freezer before they thaw. Another technology is the no-frost refrigerator/freezer where the cold surfaces of the evaporator are located outside of the freezer cavity in a separate space, and cold air is forced by a fan to flow over the evaporator. In this way, the frost layer can be melted using an electric heater and defrost water is discharged out of the compartment by a drain pipe. This technology provides automatic defrosting but consumes more energy.

The automatic defrosting offered by the no-frost freezers has additional disadvantages, such as reduced volume available for the frozen goods. Also, the no-frost freezers draw moisture from the frozen goods, so the user must wrap the goods in plastic or store the goods in boxes to prevent dehydration. Moreover, no-frost freezers are costly and less energy efficient.

Thus, an improvement over the prior art would be to improve defrosting of direct cooled freezers without the disadvantages of present manual defrosting or the disadvantages of automatic defrosting of no-frost freezers.

SUMMARY OF THE INVENTION

Accordingly, the present invention is directed to a refrigerator having an adsorbing device to improve the defrosting process.

One embodiment of the invention is a refrigerator having a cabinet forming a fresh food storage compartment and a freezer compartment, at least one door for opening and closing the cabinet, and an adsorbing device containing a desiccant material for collecting moisture from air inside the cabinet, wherein the adsorbing device is mounted inside the cabinet.

The adsorbing device may be mounted inside the food storage compartment. Additionally, it may be box-shaped and have inlet and outlet apertures to allow passage of air. The adsorbing device may comprise an enclosure having a plurality of openings. The desiccant material may include at least one of the following: silica gel, clay, zeolites, or mixtures thereof.

The adsorbing device may be mounted on the door and connected to external ambient air through an opening in the door. Additionally, the refrigerator may further comprise a valve at the opening of the door to control flow of air through the adsorbing device.

The refrigerator may further comprise a freezer compartment and evaporator. In this embodiment, the adsorbing device may be mounted on the door and connected to external ambient air through a first opening and to the freezer compartment through a second opening. Alternatively, the adsorbing device may be placed in contact with the evaporator using a removable support system. Alternatively, the adsorbing device may be placed at the bottom of the freezer compartment.

The refrigerator may further include a mullion separating the food storage space into two cavities, wherein the adsorbing device is placed in the mullion.

The adsorbing device may be removably mounted to the refrigerator.

Another embodiment of the invention is an adsorbing device including an enclosure and a desiccant material, wherein the adsorbing device is mounted within a refrigerator and the desiccant material adsorbs moisture from air inside the refrigerator.

The enclosure may be box-shaped and may have openings to allow passage of air through the desiccant material.

The invention further includes a method of defrosting an evaporator in a refrigerator having a food storage compartment and an adsorbing device by adsorbing moisture from air inside the food storage compartment.

The adsorbing device may further adsorb frost present on the evaporator.

The method may further comprise the steps of removing the adsorbing device, regenerating the device, and returning the device to the refrigerator.

BRIEF DESCRIPTION OF THE DRAWINGS

The present invention will now be described in more detail, by referring to the attached drawings in which.

DETAILED DESCRIPTION OF THE PREFERRED EMBODIMENTS

Figure 1:
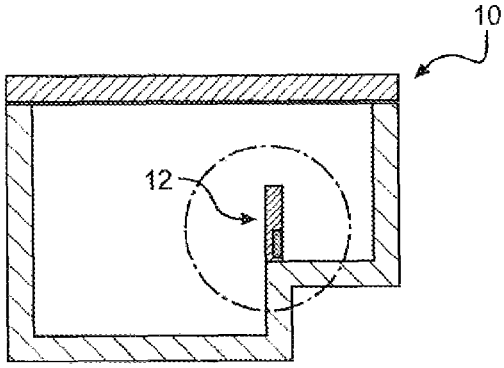
FIG. 1 is a cross sectional view of a freezer according to a first embodiment of the invention.
Figure 2:
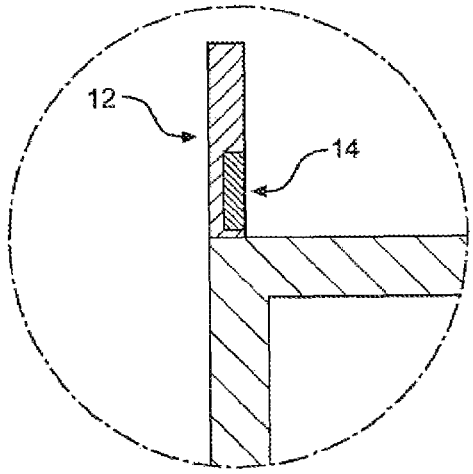
FIG. 2 is an enlarged detail of FIG. 1.

With reference to FIGS. 1 and 2, a first embodiment of a freezer 10 is shown. The freezer 10 includes a desiccant device 12 to replace the usual separator (mullion) which divides the cavity in two zones, one of which may be above the compressor compartment. As shown in FIGS. 1 and 2, the desiccant device 12 may be located within the freezer compartment, may be box-shaped, and may hold at least 1.5 kg of silica gel or other desiccant materials. The position of the device inside the enclosure, the amount of desiccant and the presence of a forced air circulation are several of the key performance drivers of the device.

The desiccant device 12 generally includes an enclosure which holds a sufficient amount of desiccant or moisture adsorbing material according to the internal volume of the enclosure of the freezer itself. The enclosure may comprise a box, disc, or various other shapes and may be constructed of various materials, such as plastic or metal. The enclosure may have solid walls, mesh walls, or walls having a plurality of openings to allow air to flow through the moisture adsorbing material. It may have one or more inlet and outlet apertures for allowing passage of air. It can be readily understood that the size, geometry and material of the enclosure could be changed without altering the function of the invention.

Moisture adsorption materials collect moisture from the air by physically trapping water vapor molecules inside molecular sieves located inside the material itself. An ideal moisture adsorbing material collects moisture from the air inside the freezer by adsorption, lowering the partial pressure of water vapor and physically neglecting sublimation of water vapor to frost. Due to this moisture adsorption, there is less free water vapor in the air inside the enclosure to sublimate and form a frost layer on the evaporator.

When frost is already present on the evaporator, lowering the partial pressure of water vapor in the air makes the frost physically de-sublimate and then it migrates into the desiccant device by means of permeation and diffusion. This ensures that until the desiccant capacity is depleted, all the water vapor entering the freezer enclosure will be trapped in the desiccant device instead of sublimating into frost.

Desiccant materials can be used at temperatures of the order of −18° C., and at such low temperature the water adsorption behavior of these materials is still satisfactory.

Many desiccant materials already known in the art can be used, including silica gel, clay, and zeolites, among many others. Additionally, specially engineered materials designed to improve their moisture adsorbing capabilities at low temperatures may be used. Zeolites have shown to be particularly suitable for use at low temperatures. In particular, type A zeolites, which are supported by clays which do not alter the adsorptive properties of the molecular sieve, are especially suitable. These zeolites include attapulgite, kaolin, sepiolite, palygorskite, kaolinite, bentonite, montmorillonite, illite, chlorite, and bentonite-type clay. Other types of zeolites may also be used, including chabazite (zeolite D), clinoptiloite, erionite, faujasite (also referred to as zeolite X and zeolite Y), ferrierite, mordenite, and zeolite P.

In the embodiment shown in FIGS. 1 and 2, an axial fan 14 may be used to force air circulation through the desiccant device 12. However, the axial fan 14 is not necessary for the invention to operate sufficiently. Furthermore, the axial fan may be used in other embodiments of the invention.

The desiccant device 12 may be provided in several locations in order to adsorb moisture from the air inside the freezer. For example, it may be provided within the freezer compartment, positioned to utilize a small portion of the available volume. Alternatively, the desiccant device 12 may be provided within the door to the freezer compartment or within the insulation of the freezer. The desiccant device 12 may also be mounted to the evaporator. In order to overcome the limitations in the performance of the desiccant materials available on the market, the applicant has optimized how the desiccant device is placed inside the freezer, developing specific configurations that bring significant advantages to the final user.

Figure 3:
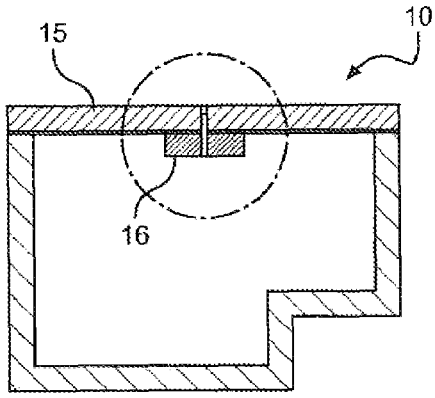
FIG. 3 is a cross sectional view of a freezer according to a second embodiment of the invention.
Figure 4:
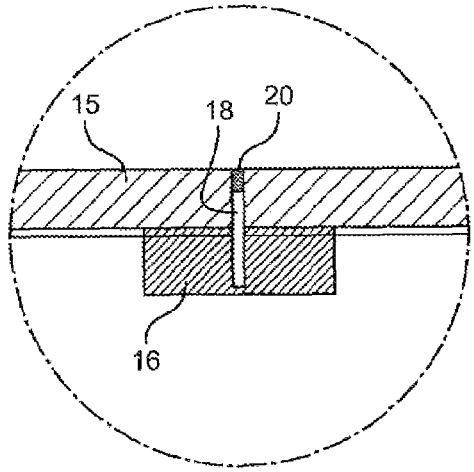
FIG. 4 is an enlarged detail of FIG. 3.

FIGS. 3 and 4 illustrate an alternative embodiment of the invention. In this embodiment, the desiccant device 16 may be placed on the inner door 15 of the freezer. The desiccant device 16 may be connected to the external ambient air by a pipe 18 equipped with a one-way valve 20. The desiccant device 16 is able to hold at least 1.5 kg of silica gel or other desiccant materials. When the freezer 10 is operating, its pressure fluctuations draw moist air inside through the door gasket. Using the present invention, pressure equilibrium is achieved but the air drawn in passes through the desiccant device 16 where its moisture content is adsorbed.

An alternative embodiment of the invention includes placing the desiccant device on the outer door of the freezer. The device may be connected to the external ambient air by a pipe, and may be connected to the internal ambient by a pipe equipped with a one-way valve passing through the door. Locating the desiccant device outside of the freezer has several advantages. For example, the performance of the desiccant is higher at room temperature. Additionally, placing the desiccant device outside of the enclosure avoids loss of storage space in the freezer. However, this location has the disadvantage of becoming saturated faster than in other embodiments, resulting in higher maintenance costs and more frequent replacements for the user.

Figure 5:
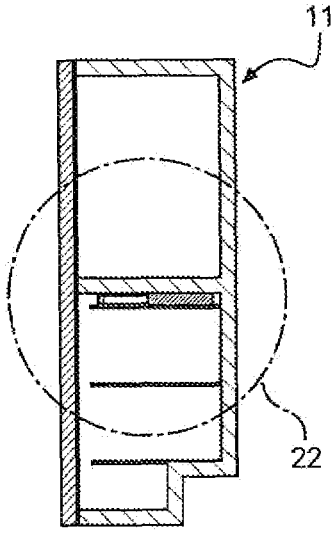
FIG. 5 is a cross sectional view of a refrigerator having a freezer compartment in the lower portion of the cabinet, according to a further embodiment of the present invention.
Figure 6:
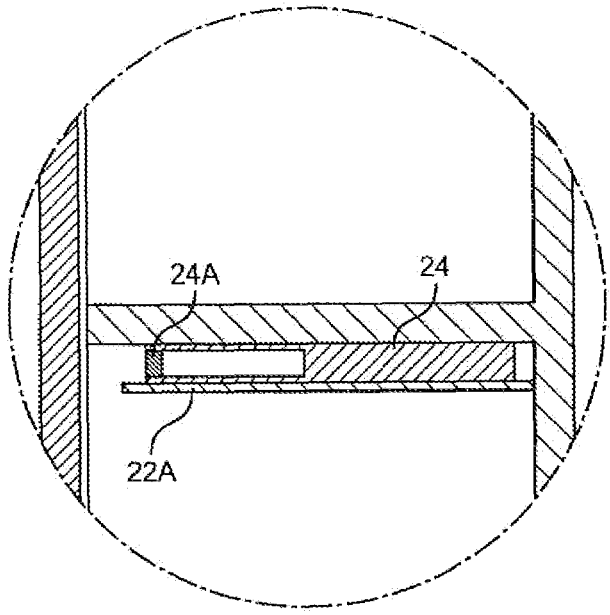
FIG. 6 is an enlarged view of a detail of FIG. 5.

Another embodiment of the present invention is shown in FIGS. 5 and 6 which relates to a refrigerator 11 having a bottom-mount freezer 22. In this embodiment a desiccant device 24 is preferably located on the upper evaporator grid 22*a*. The desiccant device may alternatively be located within the freezer compartment or mounted to the door of the freezer compartment. The device 24 may hold at least 4.6 kg of silica gel or other desiccant materials and may include at least one fan 24*a* to push air into the desiccant. The device may also operate successfully using natural air circulation without fans.

Figure 7:
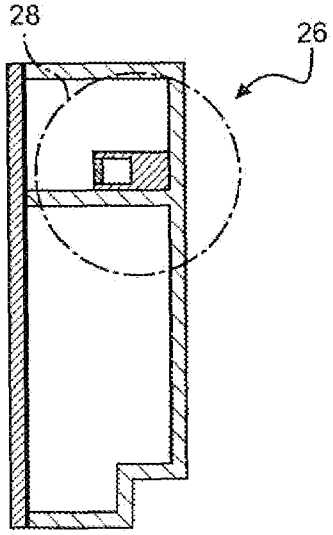
FIG. 7 is a cross sectional view of a refrigerator having a freezer compartment in the upper portion of the cabinet, according to a further embodiment of the present invention.
Figure 8:
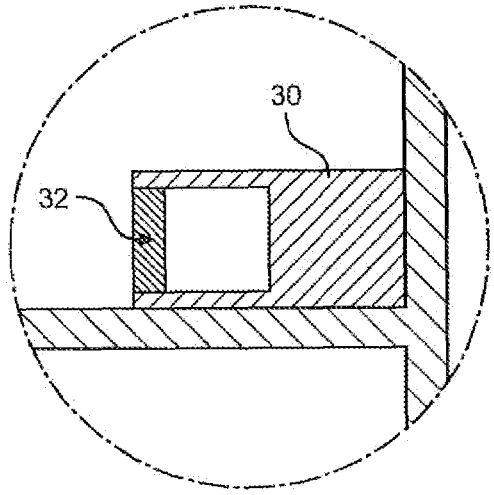
FIG. 8 is an enlarged view of a detail of FIG. 7.

Another embodiment of the invention is shown in FIGS. 7 and 8, which relates to a refrigerator 26 having a "top mount" freezer 28. For this embodiment, the evaporator may be foamed into the cabinet. The desiccant device 30 may be located on the bottom of the freezer 28 and preferably in a rear portion thereof. The device may alternatively be located elsewhere in the freezer, or mounted to the door of the freezer compartment. The desiccant device 30 may hold at least 2.5 kg of silica gel or other desiccant materials. The device may include at least one fan 32 to push air into the desiccant.

The present invention may also be used with other refrigerator configurations, such as a side-by-side refrigerator. The location, size and geometry of the desiccant device may change and be optimized based on the refrigerator configuration without altering the function of the invention.

Figures 9, 10:
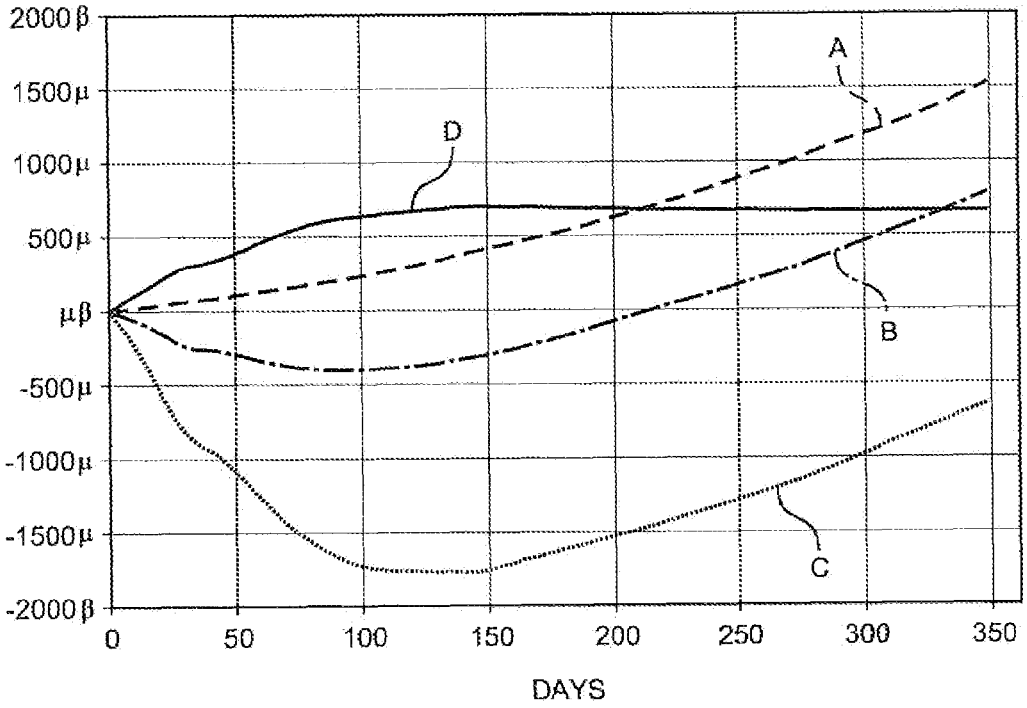
FIG. 9 is a table showing the results of the two embodiments of FIGS. 1 and 3.
FIG. 10 is a plot showing results from a freezer according to an embodiment of the present invention.

The table shown in FIG. 9 includes experimental data from a group of freezers according to the first two embodiments of the invention, as shown in FIGS. 1 and 3. The table shows the moisture adsorption process over 56 days, as measured by the weight of the desiccant device. In this experiment, three freezers were equipped with the desiccant device positioned in three different configurations. For instance, in one configuration, the desiccant device was placed in the separator without a fan (tests 3 and 4). In a second configuration, the desiccant device was placed in the separator with a fan (tests 5 and 6). Finally, in a third configuration, the desiccant device was placed on the internal surface of the door (tests 7 and 8). The weight in grams of these devices was measured weekly. The results are evidence of the adsorption process and were used to determine the quantity of desiccant needed for each type of configuration and to determine its capacity at saturation.

The plot of FIG. 10 shows the output of a mathematical model developed to extrapolate the behavior of the desiccant device over a long period of time. It shows that it is possible to delay the manual defrosting of a freezer according to the embodiment shown in FIGS. 5 and 6, from a 1-year frequency to a 2-year frequency. This tool allows us to study the behavior of the device in any embodiment and under a variable set of assumptions. The basic assumptions have been confirmed by experimental activity, in particular by measuring the maximum quantity of frost allowed in the enclosure, the maximum quantity of adsorbed moisture in the desiccant at saturation, and the speed of the adsorption inside the desiccant. In the plot, the line "A" shows the amount of moisture entering the enclosure, thus creating a frost layer in a non-protected freezer. Line "B" shows the amount of moisture available for frost formation when a desiccant device is included, according to an embodiment of the present invention. Line "B" relates to a desiccant device containing approximately 2.3 kg of desiccant material. Line "D" is the weight of the desiccant device, which increases over time due to adsorption of moisture. Therefore, line "B" is the result of the difference between lines "A" and "D". Line "C" is the equivalent of line "B" when approximately 4.5 kg of desiccant material is used. The plot shows is that in a 1-year time frame, only a fraction of the total amount of moisture remains available for frost formation, thus postponing the required date for manual defrosting.

The solution according to an embodiment of the invention provides users with an improved method to perform manual defrosting of a direct cooled freezer. Since moisture is collected inside the desiccant device, it is easy to remove the device from the freezer without turning it off. Thus, the device may be easily replaced or regenerated in a microwave oven or cooking oven and then returned to the freezer.

Additionally, according to the performance of the desiccant material and to its adsorption capacity, the manual defrost can be delayed in time, thus reducing the frequency of manual defrosting for the user, or it can be completely avoided by regeneration of the device.

The defrosting operation by using a desiccant device is an improvement over the prior art because there is no need to remove the frozen goods and turn the freezer off or do any operation to initiate the defrosting process. Thus, the freezer operation is not interrupted and the inconvenience of removing the frozen goods is avoided.

While the present invention has been described with reference to the above described embodiments, those of skill in the art will recognize that changes may be made thereto without departing from the scope of the invention as set forth in the appended claims.

What is claimed is:

1. A refrigerator comprising:

a cabinet forming a fresh food storage compartment and a freezer compartment;

at least one door for opening and closing the cabinet;

an adsorbing device containing a desiccant material for collecting moisture from air inside the cabinet mounted on the at least one door, so as to be inside the cabinet when the at least one door is closed, and connected to external ambient air through an opening in the door; and further comprising:

a one-way valve at the opening in the door to allow flow of air through the opening into the refrigerator through the adsorbing device to achieve pressure equilibrium.

2. The refrigerator of claim 1, wherein the adsorbing device is inside the freezer compartment.

3. The refrigerator of claim 1, wherein the desiccant material comprises at least one of the following: silica gel, clay, zeolites, and mixtures thereof.

4. The refrigerator of claim 1, wherein the adsorbing device comprises a box-shaped enclosure having inlet and outlet apertures to allow passage of air.

5. The refrigerator of claim 4, wherein the adsorbing device comprises an enclosure having a plurality of openings.

6. The refrigerator of claim 1, further comprising at least one fan for forcing air through the desiccant material.

7. The refrigerator of claim 1, further comprising an evaporator.

8. The refrigerator of claim 7, wherein the adsorbing device is mounted inside the freezer compartment.

9. The refrigerator of claim 1, wherein the adsorbing device is removably mounted to the refrigerator.

10. A refrigerating apparatus comprising:

a cabinet forming at least a freezer compartment;

at least one door for opening and closing the cabinet;

an adsorbing device containing a desiccant material for collecting moisture from air inside the cabinet mounted on the door, so as to be inside the cabinet when the door is closed, and connected to external ambient air through an opening in the door; and further comprising:

a one-way valve at the opening in the door to allow flow of air through the opening into the refrigerating apparatus through the adsorbing device to achieve pressure equilibrium.

* * * * *